US006132067A

United States Patent [19]

Scholz

[11] Patent Number: 6,132,067

[45] Date of Patent: Oct. 17, 2000

[54] OPERATING THEATER LAMP FOR PRODUCING A BRIGHTLY ILLUMINATED MAIN LIGHT FIELD AND A LESS BRIGHTLY ILLUMINATED OUTER LIGHT FIELD

[75] Inventor: Manfred Scholz, Seitingen, Germany

[73] Assignee: Gebrueder Berchtold GMB & Co., Tuttlingen, Germany

[21] Appl. No.: 08/958,807

[22] Filed: Oct. 28, 1997

[30] Foreign Application Priority Data

Oct. 29, 1996 [DE] Germany ..... 196 44 959

[51] Int. Cl.[7] ..... F21N 131/205

[52] U.S. Cl. ..... 362/304; 362/346; 362/804

[58] Field of Search ..... 362/302, 304, 362/343, 346, 347, 348, 350, 804

[56] References Cited

U.S. PATENT DOCUMENTS

| | | | |
|---|---|---|---|
| 1,286,535 | 12/1918 | Cochran | 362/302 |
| 2,126,650 | 8/1938 | Matera | 362/302 |
| 4,280,167 | 7/1981 | Ellett | 362/33 |
| 4,447,865 | 5/1984 | Van Horn et al. | 362/304 X |
| 4,517,632 | 5/1985 | Roos | 362/389 |
| 4,617,619 | 10/1986 | Gehly | 362/804 |
| 4,651,257 | 3/1987 | Gehly | 362/33 |
| 5,001,616 | 3/1991 | Gehly | 362/308 |
| 5,067,064 | 11/1991 | Gehly | 362/277 |
| 5,178,452 | 1/1993 | Scholz | 362/319 |
| 5,331,530 | 7/1994 | Scholz | 362/293 |
| 5,373,430 | 12/1994 | McDermott | 362/304 X |
| 5,582,478 | 12/1996 | Thomas et al. | 362/346 X |
| 5,791,768 | 8/1998 | Splane, Jr. | 362/304 X |

FOREIGN PATENT DOCUMENTS

| | | |
|---|---|---|
| 0268117A2 | 5/1988 | European Pat. Off. . |
| 0468287A2 | 1/1992 | European Pat. Off. . |
| 1045467 | 11/1957 | France . |
| 66.975 | 11/1957 | France . |
| 483 950 | 10/1929 | Germany . |
| 849 832 | 9/1952 | Germany . |
| 3238876A1 | 4/1984 | Germany . |
| 3605226A1 | 8/1987 | Germany . |
| 3638669A1 | 5/1988 | Germany . |
| 3243709C2 | 10/1990 | Germany . |
| 3243710C2 | 12/1991 | Germany . |
| 4023408A1 | 1/1992 | Germany . |
| 4033625A1 | 4/1992 | Germany . |
| 4140325A1 | 6/1993 | Germany . |

*Primary Examiner*—Laura K. Tso

*Attorney, Agent, or Firm*—Townsend and Townsend and Crew LLP

[57] ABSTRACT

The invention relates to an operating theater lamp comprising a housing having a light outlet opening at the bottom with a light source being arranged centrally in the housing and deflecting light all around it to a concave reflector, preferably a ring-like concave reflector arranged in the housing, which reflects the incident light rays to the light outlet opening and concentrates them as uniformly as possible onto a main light field arranged at a distance from the light outlet opening. The invention hereby provides that the concave reflector, and/or at least one auxiliary concave reflector arranged in its vicinity and in particular concentric to it, is or are so designed and/or arranged that a part of the light rays transmitted from the light source is reflected into an outer light field extending around the main light field and preferably adjoining the latter, in such a way that a brightly illuminated main light field and a stepped-down, less brightly illuminated outer light field is present.

10 Claims, 3 Drawing Sheets

OPERATING THEATER LAMP FOR PRODUCING A BRIGHTLY ILLUMINATED MAIN LIGHT FIELD AND A LESS BRIGHTLY ILLUMINATED OUTER LIGHT FIELD

FIELD OF THE INVENTION

The invention relates to an operating theater lamp comprising a housing having a light outlet opening at the bottom with a light source being arranged centrally in the housing and deflecting light all around it to a concave reflector, preferably a ring-like concave reflector arranged in the housing, which deflects the incident light rays to the light outlet opening and concentrates them as uniformly as possible onto a main light field arranged at a distance from the light outlet opening.

DESCRIPTION OF PRIOR ART

Such lamps are, for example, known from the German patent specifications 32 43 709 and 32 43 710. A situation is achieved by suitable design of the concave reflector in which the region of a medical operation is illuminated as brightly as possible and free of shadows. In order to ideally exploit the light of a centrally positioned lamp, one has already secured beneath the lamp a ring-like, additional reflector, which can be moved into the concave reflector in order to permit a part of the light of the lamp to be incident at a steeper angle onto the field of the operation (EP 0 468 287 B1). Furthermore, one has already provided auxiliary ring reflectors within the main, concave reflector for the purpose of reducing the size of the concave reflector with a uniform intensity of illumination (DE-OS 41 40 325).

The purpose of the special measures effected at known ring-shaped, concave reflectors is in each case to obtain a restricted field of light with a diameter of ca. 15 to 30 cm, which is illuminated as uniformly as possible. In this respect, increasingly brighter lamps and better reflecting concave reflectors have been used very recently, because bleeding flesh in an open wound absorbs a high proportion of the incident light, and only reflects a small proportion, so that the surgeon can only observe the operating procedure in a problem-free manner with an adequately high intensity of illumination. Nowadays luminous intensities of up to 150, 000 Lux are achieved with operating theater lamps, which however results in an unbearably bright and glistening light on a bright background, which rapidly tires the eyes. Since the room lighting which is available in an operating theater is intended to produce a luminous intensity of about 1000 Lux, the ratio of the maximum luminous intensity of the operating theater lamp to that of the room lighting amounts to 150:1. This leads to great tiredness of the eyes.

OBJECT OF THE INVENTION

The object of the present invention is to provide an operating theater lamp of the initially named kind which can operate with the highest luminous intensities without tiring the eyes of the surgeon.

BRIEF DESCRIPTION OF THE INVENTION

In order to satisfy this object there is provided an operating theater lamp of the initially named kind which is characterized in that the concave reflector and/or at least one auxiliary concave reflector arranged in its vicinity, and in particular concentric to it, is or are so designed and/or arranged that a part of the light rays transmitted from the light source is deflected into an outer light field extending around the main light field and preferably adjoining the latter, in such a way that a brightly illuminated main light field and a stepped-down, less brightly illuminated outer light field are present.

The concept underlying the invention is thus to be seen in the fact that an outer light field which directly surrounds and adjoins the main light field is consciously produced, which aims to go beyond the weak outer light field around the main light field, which arises as a result of scattering effects and inadequacies of the reflectors, which cannot be avoided. The luminous intensity of the outer light field should have a relationship to the luminous intensity of the main light field such that tiring of the surgeon's eyes is counteracted at least to a considerable degree. In this manner it is possible to achieve a stepping down between the maximum luminous intensity in the main light field and in the outer light field of approximately only 30:1. If one takes account of the circumstance that the very bright operating field illumination ideally only falls into the starkly absorbing wound, and the outer field illumination of the invention falls onto the environment, which does not absorb so strongly, for example green operating drapes, then the difference between the reflected light of the wound and of the outer field actually perceived by the eye is very small as a result of the measures of the invention. In this way a premature tiring of the eyes is prevented. If in contrast one had a system with a similar high peak value of the luminous intensity and a not step-like but rather uniformly decreasing luminous intensity in the outer field, then the pronounced absorption of the wound and the low absorption of the outer field would have the effect of a dark hole at the center. This is undesirable. Thus, in accordance with the invention, it is important that the drop off in the luminous intensity for the main light field to the outer light field takes place over the shortest possible path, which should be a few centimeters.

The luminous intensity should be as constant as possible within the main light field and in particular within the outer light field and should drop off radially towards the outside as little as possible. The outer diameter of the outer light field of the invention lies at approximately 50 to 90 cm, it should however amount to at least 40 cm.

BRIEF LISTING OF THE FIGURES

FIG. 1 is a schematic side view of an operating theater lamp in accordance with the invention, with the operating field located beneath it in accordance with a first embodiment of the invention, FIG. 2 is a corresponding schematic view of another embodiment, and FIG. 3 is a diagram of the dependency of the luminous intensity B in kLux in dependence on the radius r of the circular operating field 24.

DESCRIPTION OF PREFERRED EMBODIMENTS

Figure 1:
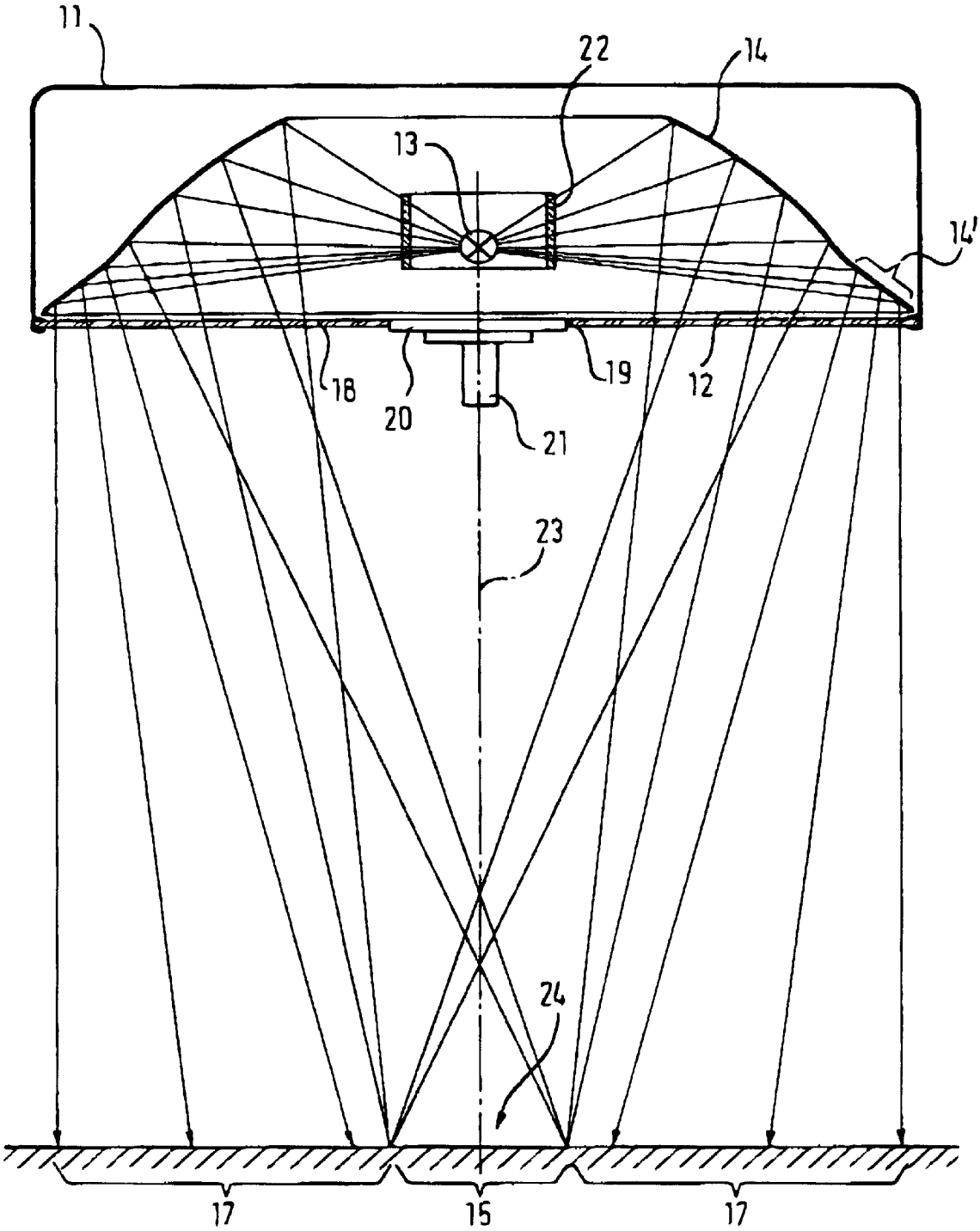

In accordance with FIG. 1 a concave ring reflector 14 with a central axis 23 is arranged in the downwardly open housing 11 of an operating theater lamp in accordance with the invention and is substantially parabolically or partly spherically designed. The concave reflector 14 has at the bottom a light outlet opening 12 which is covered over by a light permeable plate 18, for example of cathedral glass, provided at the open side of the housing. The plate 18 has, at the center, an opening 19, in which a plate arrangement 20 with a handle 21 is secured for the pivoting of the housing 11.

A lamp 13 is secured above the plate arrangement 20 in the region of the focal point of the concave reflector 14 and is surrounded by a round cylindrical filter 22, which primarily absorbs infrared radiation, which can intercept all the light which passes to the concave reflector 14 and which can also filter out ultraviolet components.

Whereas the concave reflector 14 is parabolically or partly spherically designed over the largest part of its surface in order to concentrate the light radiated from the lamp 13 onto an operating field 24, in a main light field 15 arranged at a distance beneath the housing 11, and to largely uniformly illuminate the main light field 15 rotationally symmetrically about the central axis 23 of the housing 11, the lower region of the concave reflector 14 is slightly convexly curved and ultimately conically outwardly divergently formed in such a manner that a ring-like region 14' concentric to the central axis 23 arises in the lower end region of the concave reflector 14, which deflects the light from the lamp incident there intentionally into an outer light field 17, which surrounds and radially adjoins the main light field 15. The design and size of the ring-like region 14' are selected such that the outer light field 17 is also uniformly illuminated but with a luminous intensity which is clearly reduced in the ratio of, for example, 1:30 in relationship to the luminous intensity in the main light field 15.

Figure 3:
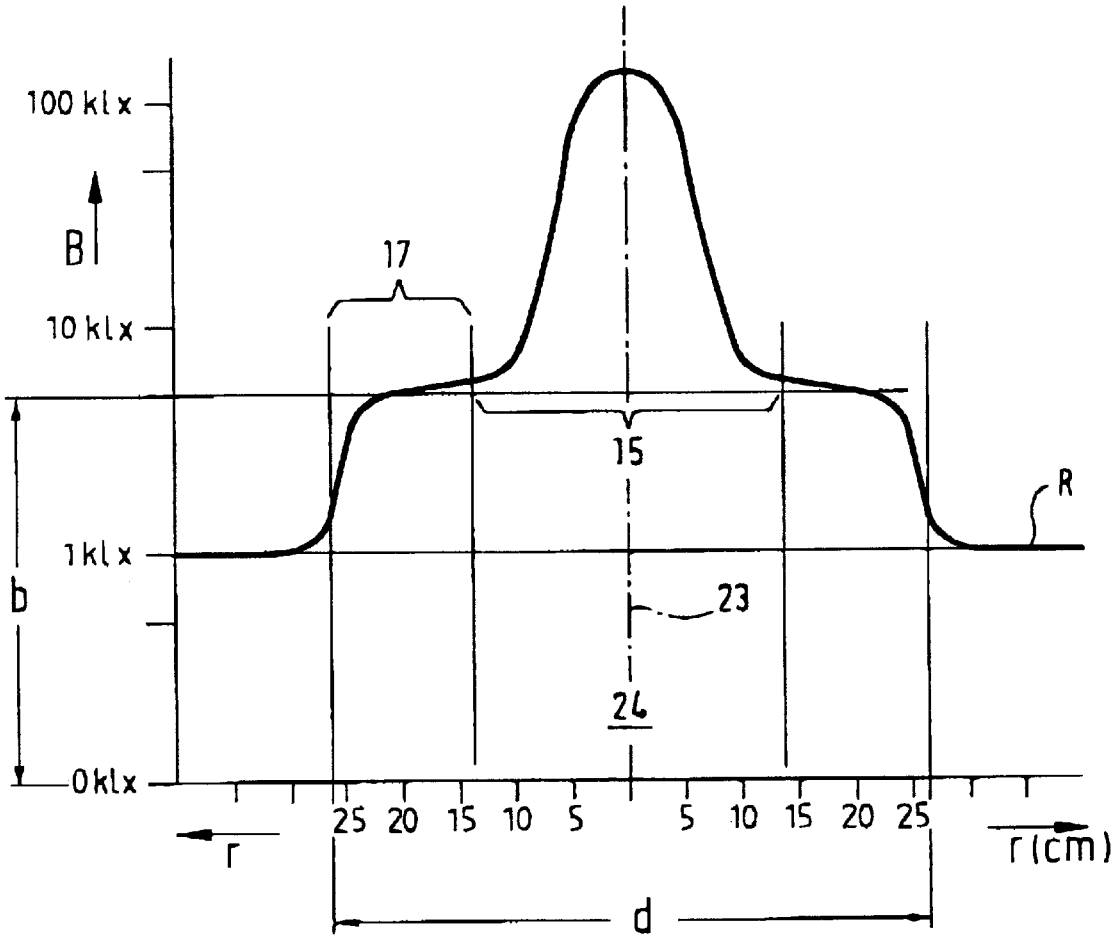

In FIG. 3 there is shown the light distribution which can be achieved by the described operating theater lamp, with the dependency of the luminous intensity in kLux on the radius of the main light field 15 and of the outer light field 17 concentric thereto being schematically reproduced.

One recognizes from this diagram that the maximum luminous intensity in the region of the central axis 23 of the housing 11 amounts to over 100 kLux and then drops off up to a region at a diameter of approximately 28 cm to a value significantly under 10 kLux, which corresponds to the luminous intensity in the outer light field 17. From this diameter on, the luminous intensity remains approximately constant, up to a diameter of approximately 50 cm and drops off here only slightly in order to ultimately merge at a diameter of approximately 60 cm into the luminous intensity R of the room lighting, which lies at approximately 1 kLux. The luminous intensity B in the outer light field 17 lies at approximately 5 to 30 kLux.

Figure 2:
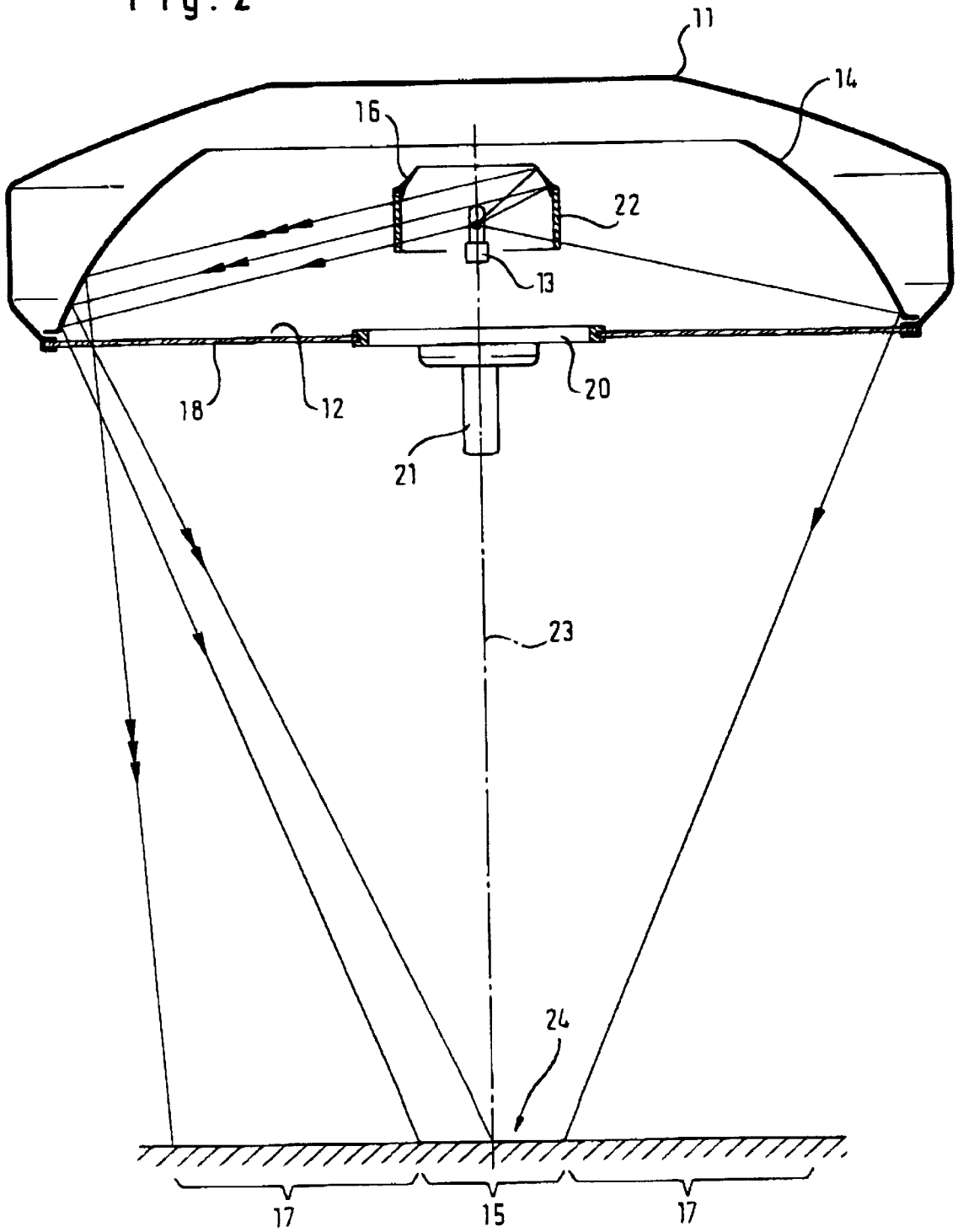

In the embodiment of FIG. 2 the same reference numerals are used to designate components which correspond to those in FIG. 1.

In contrast to the embodiment of FIG. 1, the concave ring reflector 14 extends parabolically or partly spherically up to its largest diameter. Within the upper central opening of the concave reflector 14, there is however arranged an auxiliary ring reflector 16 which has an inclination and/or curvature such that the light of the lamp 13 incident on it is deflected over a part of the main concave reflector 14 into the outer light field 17 and into the main light field 15, so that a gap in the illumination can never arise between the main light field 15 and the outer light field 17, as a result of the overlap in the main light field 1 5, even with a change of the working distance.

What is claimed is:

1. An operating theater lamp comprising:

a housing having a light outlet opening;

a light source being arranged centrally in the housing;

a concave reflector for reflecting incident light rays from the light source as reflected light rays to the light outlet opening and concentrating the reflected light rays generally uniformly onto a main light field arranged at a distance from the light outlet opening; and an auxiliary concave reflector disposed within the concave reflector for reflecting incident light rays from the light source to illuminate an outer light field surrounding and adjoining the main light field, wherein the main light field is illuminated at least substantially only by the reflected light rays from the concave reflector.

2. An operating theater lamp in accordance with claim 1 wherein the concave reflector is a ring-like concave reflector arranged in the housing.

3. An operating theater lamp in accordance with claim 1 wherein the auxiliary concave reflector is a circular, ring-like reflector arranged in the housing.

4. An operating theater lamp in accordance with claim 1 wherein the auxiliary concave reflector comprises a surface treated to produce a softly illuminated outer light field which is less brightly illuminated than the main light field.

5. An operating theater lamp in accordance with claim 4 wherein the treated surface comprises a mat surface or a structured surface.

6. An operating theater lamp in accordance with claim 1 wherein the ratio of the luminous intensity of the main light field and the luminous intensity of the outer light field is 50:1 to 5:1.

7. An operating theater lamp in accordance with claim 6 wherein the ratio of the luminous intensity of the main light field and the luminous intensity of the outer light field is 40:1 to 20:1.

8. An operating theater lamp in accordance with claim 7 wherein the ratio of the luminous intensity of the main light field and the luminous intensity of the outer light field is 30:1.

9. An operating theater lamp in accordance with claim 1 wherein the outer diameter of the main light field and the outer diameter of the outer light field has a ratio of 1:2 to 1:10.

10. An operating theater lamp in accordance with claim 9 wherein the outer diameter of the main light field and the outer diameter of the outer light field has a ratio of 1:3.

* * * * *